US009826813B2

(12) United States Patent
Lee

(10) Patent No.: US 9,826,813 B2
(45) Date of Patent: Nov. 28, 2017

(54) AIRLESS PUMP CONTAINER EQUIPPED WITH IMPREGNATED MEMBER AND ABSORBING MEMBER

(71) Applicant: PUM-TECH KOREA CO., LTD, Incheon (KR)

(72) Inventor: Do Hoon Lee, Incheon (KR)

(73) Assignee: PUM-TECH KOREA CO., LTD, Bupyeong-gu, Incheon (KR)

( * ) Notice: Subject to any disclaimer, the term of this patent is extended or adjusted under 35 U.S.C. 154(b) by 39 days.

(21) Appl. No.: 14/784,913

(22) PCT Filed: Apr. 16, 2014

(86) PCT No.: PCT/KR2014/003303
§ 371 (c)(1),
(2) Date: Oct. 15, 2015

(87) PCT Pub. No.: WO2014/171732
PCT Pub. Date: Oct. 23, 2014

(65) Prior Publication Data

US 2016/0235183 A1 Aug. 18, 2016

(30) Foreign Application Priority Data

Apr. 19, 2013 (KR) ..... 20-2013-0003063 U

(51) Int. Cl.
*B43K 5/02* (2006.01)
*A45D 34/04* (2006.01)
(Continued)

(52) U.S. Cl.
CPC ..... *A45D 34/04* (2013.01); *A45D 34/00* (2013.01); *B01F 15/0087* (2013.01);
(Continued)

(58) Field of Classification Search
CPC .... A45D 634/04; A45D 34/043; A45D 40/26; A45D 40/264; A45D 2200/056; A45D 2200/1036
(Continued)

(56) References Cited

U.S. PATENT DOCUMENTS 8,267,610 B2 * 9/2012 Goodman ..... B05C 17/002 222/183
8,499,970 B2 * 8/2013 Yoo ..... A45D 34/00 116/227
2014/0154295 A1 * 6/2014 Sim ..... A61K 8/87 424/401

FOREIGN PATENT DOCUMENTS

KR 10-0781975 B1 12/2007
KR 10-2009-0065146 A 6/2009
(Continued)

*Primary Examiner* — Jennifer C Chiang
(74) *Attorney, Agent, or Firm* — East West Law Group; Heedong Chae

(57) ABSTRACT

An airless pump container equipped with an impregnated member and an absorbing member includes: a container main body (10); a pushing plate (20); an impregnated member (30) installed inside of the container main body (10); a shielding member (40); a pump holder (60) coupled to the upper portion of the shielding member (40); an airless pump (50) installed on the inside of the shielding member (40) and the pump holder (60); an absorbing member holder (70) coupled to the upper end of the airless pump (50); an absorbing member (90); and a moving member (100) for fixing the absorbing member (90). The impregnated member is impregnated with content in a gel-state.

16 Claims, 6 Drawing Sheets

(51) Int. Cl.

| | |
|---|---|
| ***A45D 34/00*** | (2006.01) |
| ***B01F 15/00*** | (2006.01) |
| ***B01F 15/02*** | (2006.01) |
| ***B05B 11/00*** | (2006.01) |
| ***B05B 15/00*** | (2006.01) |
| ***B05C 17/00*** | (2006.01) |
| *A45D 40/24* | (2006.01) |

(52) U.S. Cl.
CPC ..... *B01F 15/0227* (2013.01); *B05B 11/0048* (2013.01); *B05B 11/3023* (2013.01); *B05B 11/3052* (2013.01); *B05B 15/002* (2013.01); *B05C 17/002* (2013.01); *A45D 40/24* (2013.01); *A45D 2200/056* (2013.01)

(58) Field of Classification Search
USPC ..... 401/188 R
See application file for complete search history.

(56) References Cited

FOREIGN PATENT DOCUMENTS

| | | | | |
|---|---|---|---|---|
| KR | 20090065146 | * | 6/2009 | ..... A45D 34/04 |
| KR | 10-2011-0078516 A | | 7/2011 | |
| KR | 10-2013-0001688 A | | 1/2013 | |

* cited by examiner

AIRLESS PUMP CONTAINER EQUIPPED WITH IMPREGNATED MEMBER AND ABSORBING MEMBER

CROSS-REFERENCE TO RELATED APPLICATION

This application claims the benefit of Korean Application No. 20-2013-0003063 filed on Apr. 19, 2013 with the Korean Intellectual Property Office, The disclosure of which is incorporation herein by reference.

TECHNICAL FIELD

The present invention relates to an airless pump container equipped with an impregnated member and an absorbing member, and more specifically, to an airless pump container equipped with an impregnated member and an absorbing member, wherein the impregnated member is impregnated with content in a gel state so that evenly mixed content in the gel-state may be used, and the content in the gel-state is more evenly mixed by the absorbing member.

BACKGROUND ART

In general, cosmetics are manufactured by mixing mutually different materials having mutually different specific gravity, and the cosmetic materials may be classified into water-in-oil (W/O) emulsion type cosmetic material and oil-in-water (O/W) emulsion type cosmetic material obtained by mixing water-based material and oil-based material such as an emulsifying agent including a surface active agent.

The water-in-oil emulsion type cosmetic material has a larger quantity of oil than that of water and is oily so that the absorption of skin is slow. Although the touch feeling of the water-in-oil emulsion type cosmetic material is heavy, the persistence is longer than that of the oil-in-water emulsion type cosmetic material. The oil-in-water emulsion type cosmetic material has a larger quantity of water than that of oil and is little oily so that the absorption of skin is fast. Although the touch feeling of the water-in-oil emulsion type cosmetic material is flash and light, the persistence is low.

Therefore, the cosmetics requiring persistence are manufactured by using the W/O emulsion type cosmetic material to increase water resistance against sweat and water.

Although the touch feeling of the W/O emulsion type cosmetic material is heavy and sticky, the defects may be compensated by reducing the viscosity of content. However, when the water-in-oil product having low viscosity remains for a long time in circulation, the aqueous material of internal phase and the oil materials of external phase may be separated from each other. In this case, a user shakes a container to mix the separated aqueous and oil materials with each other for use, but it is inconvenient to shake the container for use.

To solve the problems, there has been disclosed a container having an agitating wing to mix contents in the container well without directly shaking the container in Korean Registered Utility Model No. 20-464645. However, it is inconvenient to operate the agitating wing by rotating a lower end of the container every time it is used. In addition, the structure is complex because the agitating wing must be formed and operated in the container.

DISCLOSURE

Technical Problem

To solve the problems described above, an object of the present invention is to provide an airless pump container equipped with an impregnated member and an absorbing member, which is capable of evenly mixing gel-state contents through the impregnated member when the gel-state contents are discharged for use and of using the gel-state contents more evenly mixed with each other while allowing the gel-state contents primarily mixed by the impregnated member to pass through the absorbing member.

In addition, another object of the present invention is to provide an airless pump container equipped with an impregnated member and an absorbing member, which is not required to be shaken because the gel-state contents are impregnated into the impregnated member so that the container is convenient in use.

In addition, still another object of the present invention is to provide an airless pump container equipped with an impregnated member and an absorbing member, which is capable of directly applying gel-state contents impregnated into the impregnated member on a skin after allowing the gel-state contents to pass through the absorbing member to be more evenly mixed with each other when the gel-state content is discharged for use, so that the container is convenient in use.

Technical Solution

According to the present invention, there is provided an airless pump container equipped with an impregnated member and an absorbing member, which includes: a container main body (10) inside of which an accommodating space is formed; a pushing plate (20) formed on an inner lower end of the container main body (10); the impregnated member (30) installed in the container main body (10); a shielding member (40) placed on a top end of the impregnated member (30); a pump holder (60) coupled to an upper portion of the shielding member (40); an airless pump (50) installed in the shielding member (40) and the pump holder (60); an absorbing member holder (70) coupled to an upper end of the airless pump (50); the absorbing member (90) installed in the absorbing member holder (70); and a moving member (100) for fixing the absorbing member (90) and guiding a vertical movement of the absorbing member (90).

Preferably, the pump holder 60 is coupled to a container cap 110 for protecting the absorbing member 90 from an outside while being covered by the container cap 110.

Preferably, a discharge plate 80 for allowing the gel-state content to be evenly absorbed into the absorbing member 90 is installed into the absorbing member holder 70 according to the present invention.

Preferably, the absorbing member holder 70 according to the present invention is provided at a lower portion thereof with an extension part 77 coupled to the airless pump 50.

Preferably, the shielding member 40 according to the present invention is provided with a pump coupling hole 42 formed on a central portion of the shielding member 40 to fix the impregnated member 40, and an upper extension part 44 formed along an outer periphery of the shielding member 40 and coupled to the pump holder 60.

Preferably, the pump holder 60 according to the present invention includes a moving member guide 62 for guiding a vertical movement of the moving member 100 and a lower extension part 64 coupled to the upper extension part 44 of the shielding member 40.

In addition, preferably, the moving member 100 is provided with a coupling ring protrusion 104 for fixing the absorbing member holder 70 on which the absorbing member 50 is installed.

Advantageous Effects

The airless pump container equipped with an impregnated member and an absorbing member according to the present invention can evenly mix gel-state contents through the impregnated member when the gel-state contents are discharged for use and can use the gel-state contents more evenly mixed with each other while allowing the gel-state contents primarily mixed by the impregnated member to pass through the absorbing member.

In addition, the airless pump container equipped with an impregnated member and an absorbing member is not required to be shaken because the gel-state contents are impregnated into the impregnated member, so that the container is convenient in use.

In addition, the airless pump container equipped with an impregnated member and an absorbing member can directly apply gel-state contents impregnated into the impregnated member onto a skin after allowing the gel-state contents to pass through the absorbing member to be more evenly mixed with each other when the gel-state content is discharged for use, so that the container is convenient in use.

BEST MODE

Mode for Invention

Hereinafter, an airless pump container equipped with an impregnated member and an absorbing member according to the present invention will be described with reference to accompanying drawings as follows.

Figure 1:
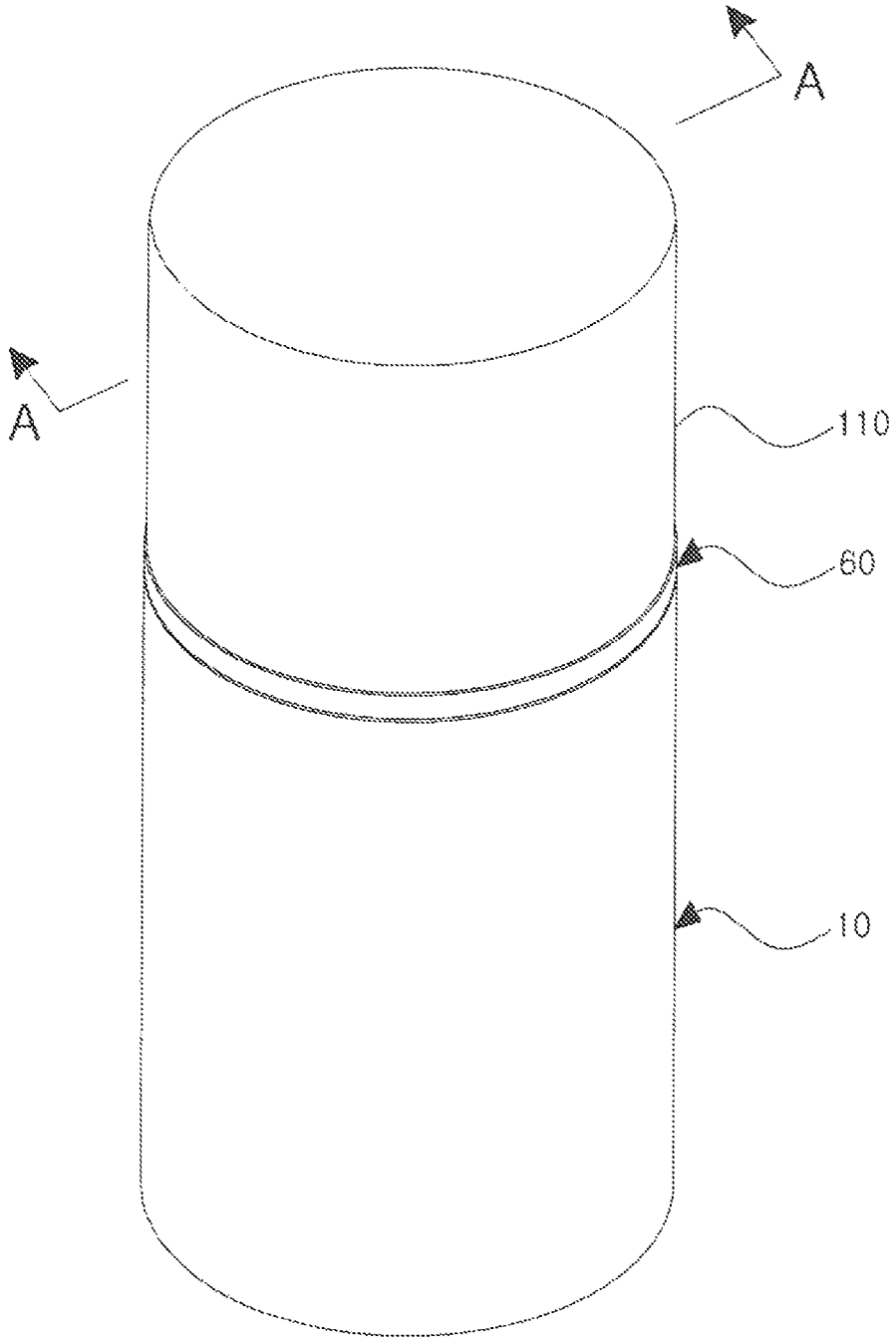
FIG. 1 is a perspective view showing an airless pump container equipped with an impregnated member and an absorbing member according to the present invention.
Figure 2:
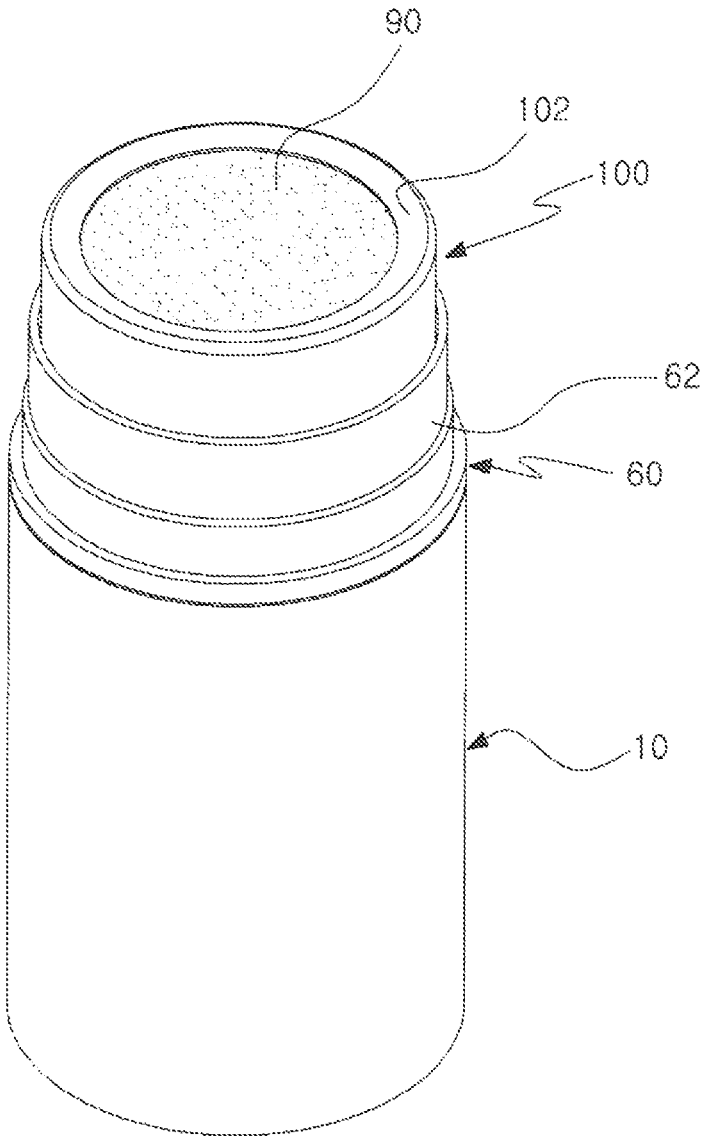
FIG. 2 is a perspective view showing an airless pump container equipped with an impregnated member and an absorbing member from which a container cap is removed according to the present invention.
Figure 3:
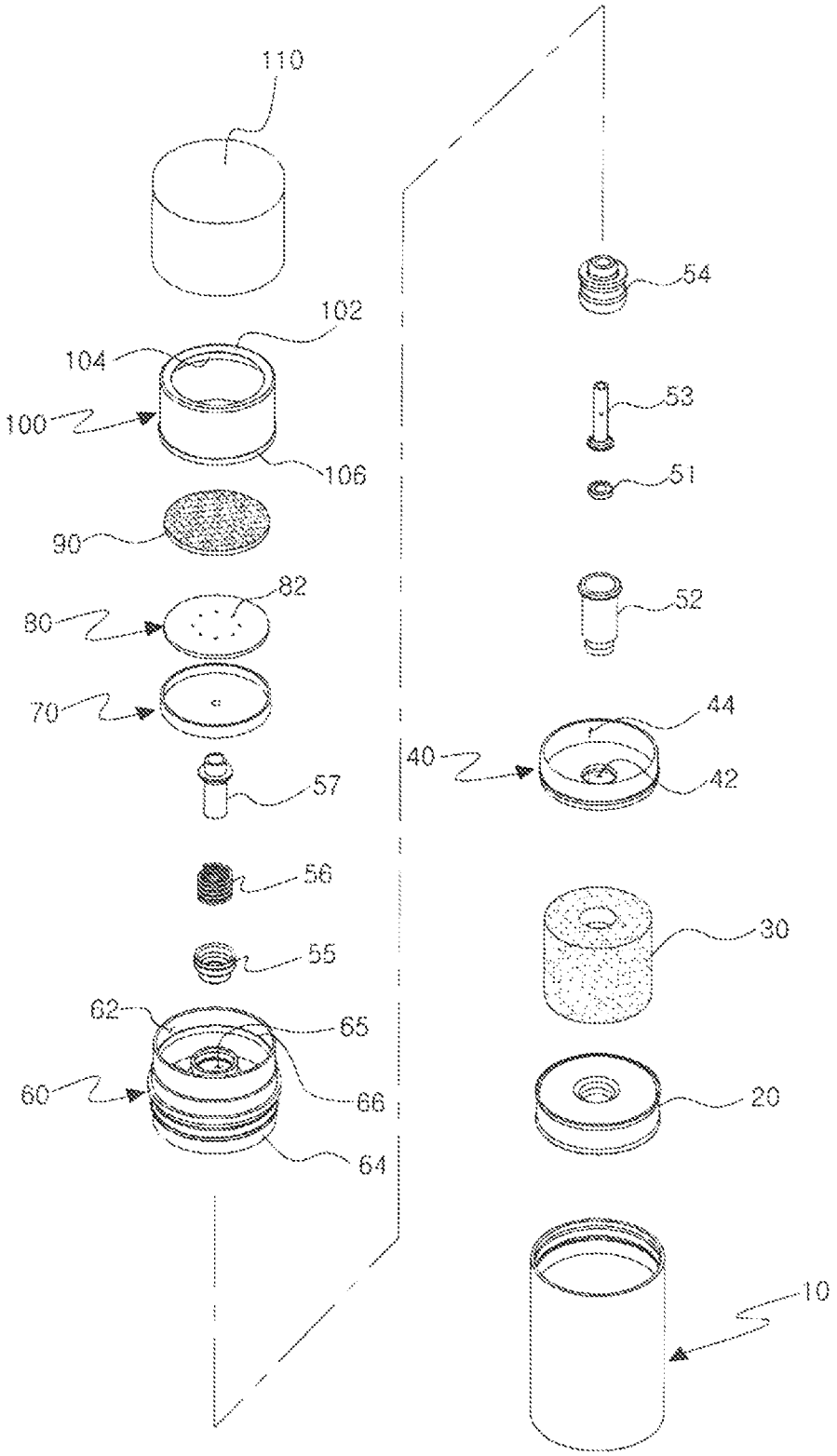
FIG. 3 is an exploded perspective view showing an airless pump container equipped with an impregnated member and an absorbing member according to the present invention.
Figure 4:
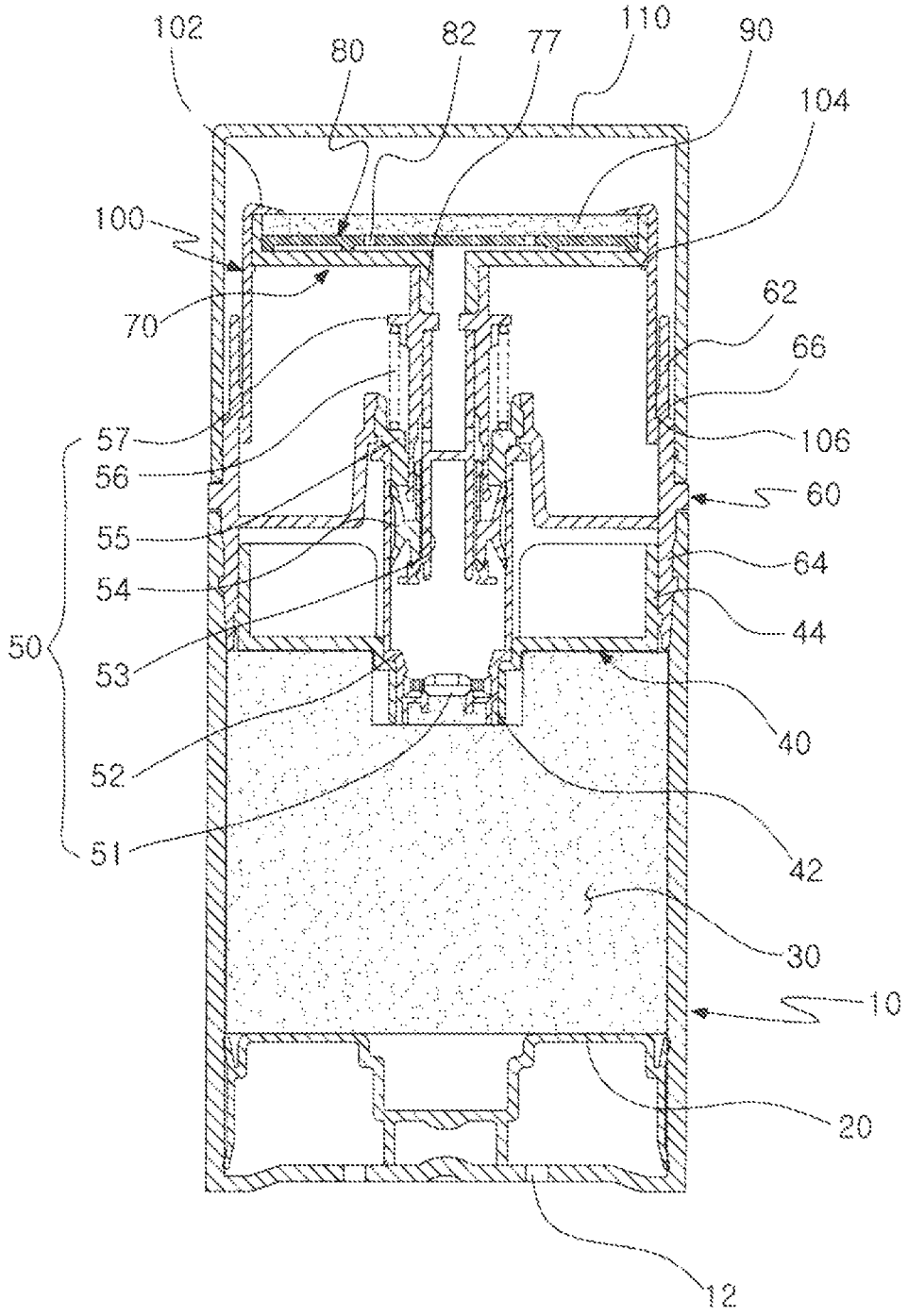
FIG. 4 is a sectional view showing an airless pump container equipped with an impregnated member and an absorbing member according to the present invention.
Figure 5:
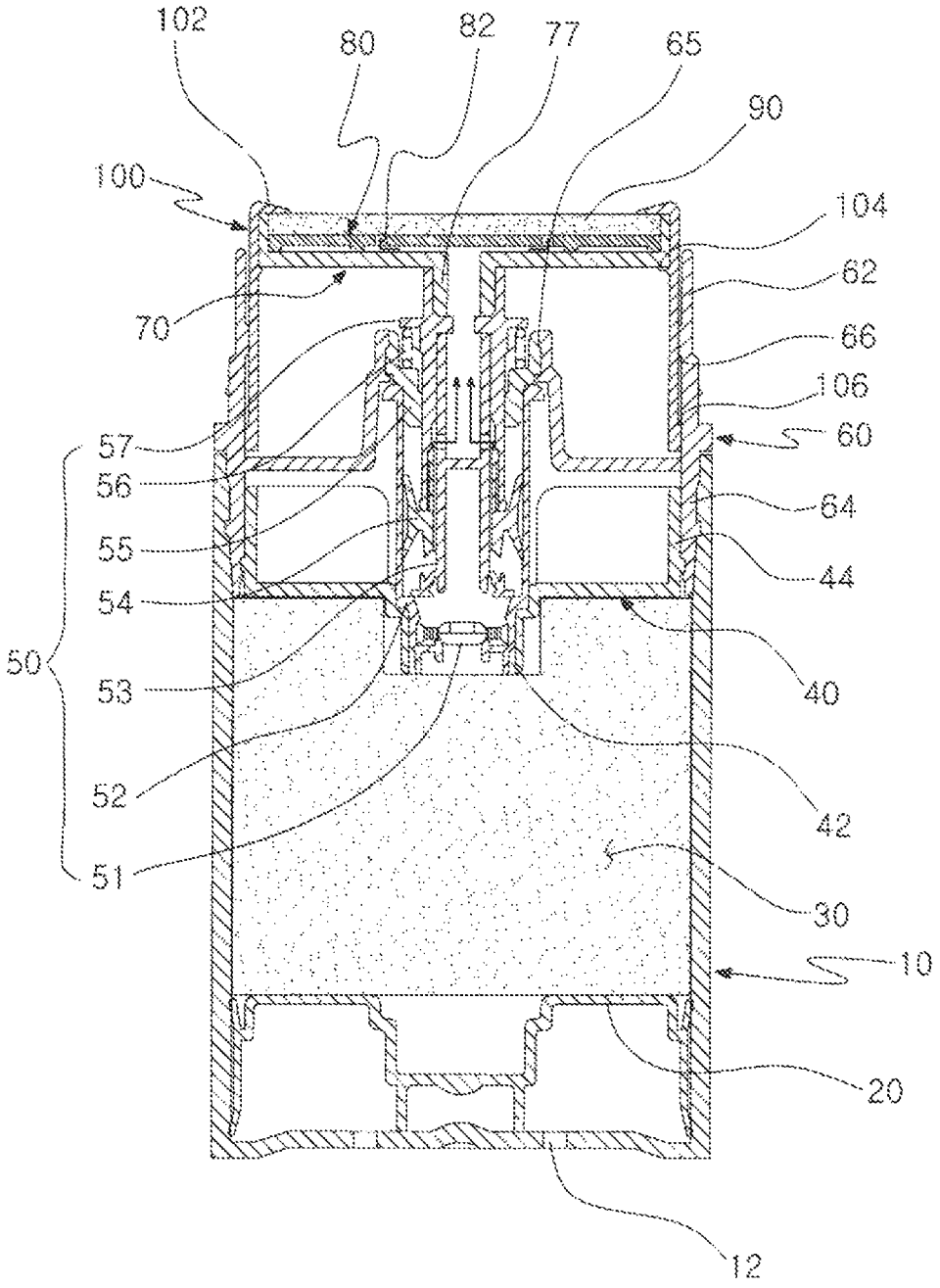
FIG. 5 is a sectional view showing an airless pump container equipped with an impregnated member and an absorbing member from which a container cap is removed according to the present invention.
Figure 6:
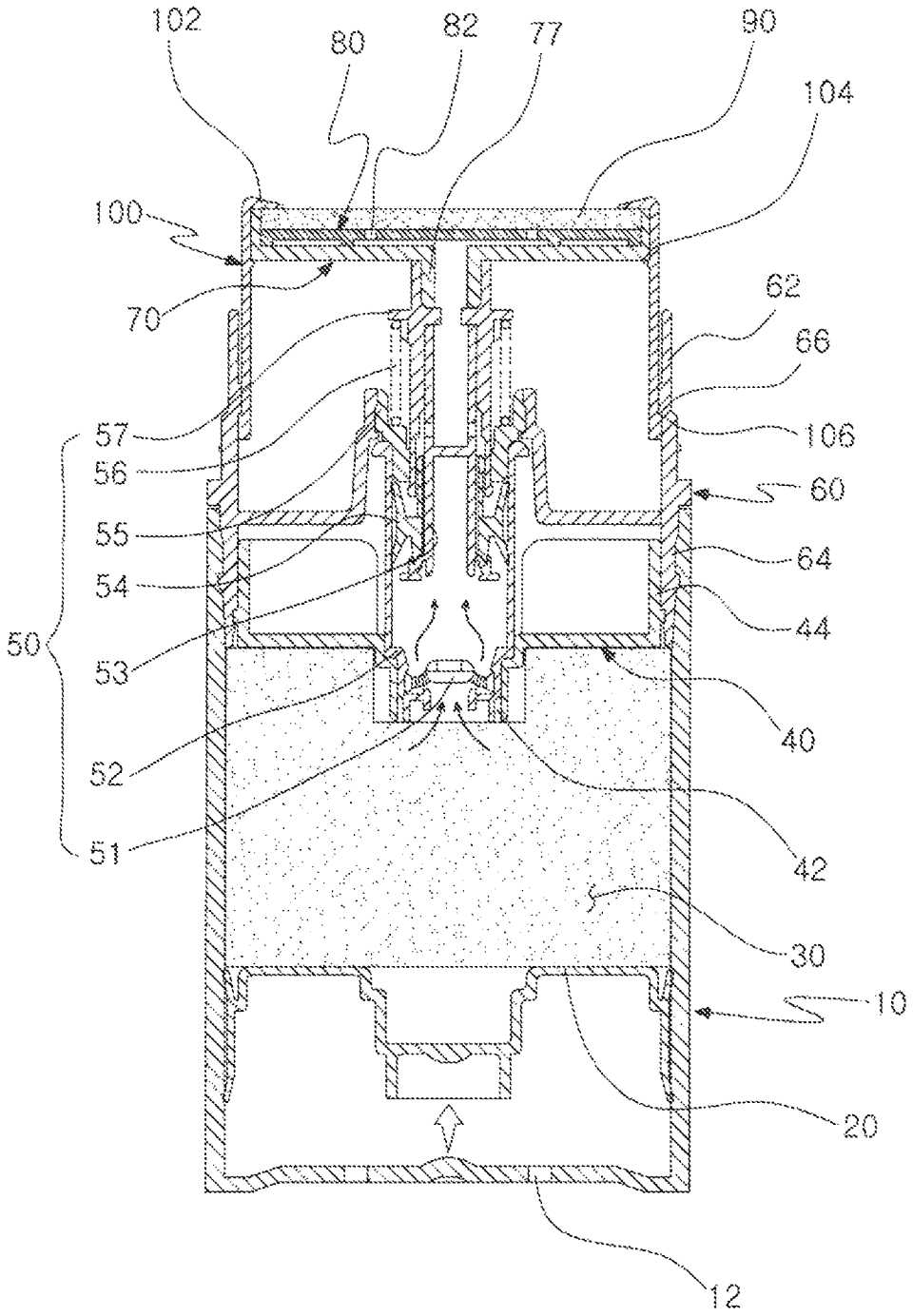
FIG. 6 is a sectional view showing a using state of an airless pump container equipped with an impregnated member and an absorbing member according to the present invention.

FIG. 1 is a perspective view showing an airless pump container equipped with an impregnated member and an absorbing member according to the present invention. FIG. 2 is a perspective view showing an airless pump container equipped with an impregnated member and an absorbing member from which a container cap is removed according to the present invention. FIG. 3 is an exploded perspective view showing an airless pump container equipped with an impregnated member and an absorbing member according to the present invention. FIG. 4 is a sectional view showing an airless pump container equipped with an impregnated member and an absorbing member according to the present invention. FIG. 5 is a sectional view showing an airless pump container equipped with an impregnated member said an absorbing member from which a container cap is removed according to the present invention. FIG. 6 is a sectional, view showing a using state of an airless pump container equipped with an impregnated member and an absorbing member according to the present invention According to the present invention, an airless pump container equipped with an impregnated member and an absorbing member includes; a container main body (10) inside of which an accommodating space is formed; a pushing plate (20) formed on an inner lower end of the container main body (10); the impregnated member (30) installed in the container main body (10); a shielding member (40) placed on a top end of the impregnated member (30) a pump holder (60) coupled to an upper portion of the shielding member (40); an airless pump (50) installed in the shielding member (40) and the pump holder (60); an absorbing member holder (70) coupled to an upper end of the airless pump (50); the absorbing member (90) installed in the absorbing member holder (70); and a moving member (100) for fixing the absorbing member (90) and guiding a vertical movement of the absorbing member (90).

Preferably, the pump holder 60 according to the present invention is coupled to a container cap 110 for protecting the absorbing member 90 from an outside while being covered by the container cap 110.

Preferably, a discharge plate 80 for allowing the gel-state content to be evenly absorbed into the absorbing member 90 is installed into the absorbing member holder 70 according to the present invention.

Preferably, the absorbing member holder 70 according to the present invention is provided at a lower portion thereof with an extension part 77 coupled to the airless pump 50.

Preferably, the shielding member 40 according to the present invention is provided with a pump coupling hole 42 formed on a central portion of the shielding member 40 to fix the impregnated member 30, and an upper extension part 44 formed along an outer periphery of the shielding member 40 and coupled to the pump holder 60.

Preferably, the pump holder 60 according to the present invention includes a moving member guide 62 for guiding a vertical movement of the moving member 100 and a lower extension part 64 coupled to the upper extension part 44 of the shielding member 40.

In addition, preferably, the moving member 100 is provided with a coupling ring protrusion 104 for fixing the absorbing member holder 70 on which the absorbing member 90 is installed.

The container main body 10 receives the pushing plate 20 and the impregnated member 30 and an air hole 12 is formed on a lower portion of the container main body 10. As air is input through the air hole 12, the pushing plate 20 is smoothly elevated.

The pushing plate 20 is formed on an inner lower end of the container main body 10 and the gel-state contents impregnated into the impregnated member 30 is discharged by pushing upwardly the impregnated member 30 through the pumping of the airless pump 50.

The impregnated member 30 is foam of an open cell type and impregnated with the gel-state contents, so that the gel-state contents are not separated from each other due to the surface tension of the foam.

The impregnated member 30 includes at least one selected from the group consisting of butadiene rubber, styrene butadiene rubber, natural rubber, wet urethane, dry urethane, polyether, polyester, polyvinyl chloride, polyethylene, ethylene vinyl acetate, latex, silicon, styrene isoprene styrene, styrene ethylene butylene styrene, polyvinyl alcohol, silicone agent elastomer, nitrile rubber, butyl rubber and neoprene.

The shielding member 40, which is placed on an upper end of the impregnated member 30, is provided with a pump coupling hole 42 formed on the central portion of the shielding member 40, and provided with the upper extension part 44 which is formed along the outer periphery of the shielding member 40 and coupled to the pump holder 60.

When the impregnated member 30 is downwardly pressed to discharge the gel-state contents as the pushing plate 20 is elevated, the shielding member 40 is operated as a shielding plate, so that the impregnated member 30 is prevented from moving up. A pump coupling hole 42 is formed on a central portion of the shield member 40 and coupled to the airless pump 50 so that the gel-state contents are discharged to an outside. The upper extension part 41 formed on the outer periphery of the shield member 40 is coupled to the lower extension part 64 of the pump holder 60 to allow the shield member 40 to be placed on the upper end of the container main body 10.

The airless pump 50 discharges the gel-state contents impregnated into the impregnated member 30 and is coupled to a shielding member coupling hole 65 of the pump holder 60 and the pump coupling hole 42 of the shield member 40. The airless pump 50 includes a check valve 51, a piston road 53, a support tube 57 coupled through an inside of a sealing member 55 to the sealing member 55 coupled to the piston valve 54 and a sealing member coupling hole 65 of the pump holder 60, and an elastic member 56 formed between the support tube 57 and the sealing member 55.

The housing 52 is placed in the pump coupling hole 42 of the shielding member 40 and the check valve 51 is installed on the inner lower end of the housing 52 to enable the gel-state contents to flow into the housing 52. The housing 52 is coupled to the pump coupling hole 42 of the shielding member 40 and the check valve 51 is installed to an inner lower end of the housing 52 such that the gel-state contents flow into the housing 52. The housing 52 includes the piston road 53 movable up and down, the piston valve 54 tightly attached to an outer surface of the piston road 53, and a sealing member 55 placed on an upper portion of the piston valve 54 and coupled to the sealing member coupling hole 65 of the pump holder 60. The support tube 57, which presses the piston road 53 to move down when external force is applied thereto, is provided on the upper portion of the piston road 53. The support tube 57 is installed to surround the upper portion of the piston road 53. The elastic member 56 for upwardly supporting the support tube 57 is installed between the sealing member 55 and the support tube 57.

The pump holder 60 according to the present invention includes a moving member guide 62 for guiding a vertical movement of the moving member 100 and a lower extension part 64 coupled to the upper extension part 44 of the shielding member 40. In addition, the sealing member coupling hole 65, to which the sealing member 55 is coupled, is formed on the central portion of the pump holder 60. The moving member guide 62 guides the vertical movement of the moving member 100 and a latching ledge 66 formed inside the moving member guide 62 restricts the moving member 100. A container cap 110 is coupled to an outside of the moving member guide 62 to protect the absorbing member 90 from an outside. An inside of the lower extension part 64 is coupled to the upper extension part 44 of the shielding member 40 and an outside is coupled to the upper end of the container main body 10. The sealing member coupling hole 65 is formed at the center of the pump holder 60 and coupled to the sealing member 55 of the airless pump 50 to fix the upper portion of the airless pump 50.

The absorbing member 90 is installed in the absorbing member holder 70 and an extension part 77 is formed on a lower portion of the absorbing member holder 70. The extension part is inserted into the support tube 57 on the upper end of the airless pump 50. Although the gel-state contents are directly discharged to the absorbing member 90 through a central hollow hole of the absorbing member holder 70, a discharge plate 80 for allowing the gel-state contents to be evenly absorbed into the absorbing member 90 may be installed.

The discharge plate 80 is installed in the absorbing member holder 70 and is provided with a plurality of discharge holes 82 through which the gel-state contents may be evenly absorbed by the absorbing member 90. The discharge holes 82 may be radially formed such that the gel-state contents may be evenly absorbed by the absorbing member 90.

The absorbing member 90 is installed in the absorbing member holder 70. The gel-state contents discharged through the discharge plate 80 are more evenly mixed with each other while passing through the absorbing member 90. The gel-state contents may be directly coated on a skin through the absorbing member 90, or and may be used after being coated on a separated puff.

The absorbing member 90 is made of the same material as that of the impregnated member 30 and is an open-cell foam.

The absorbing member 90 includes at least one selected from the group consisting of butadiene rubber, styrene butadiene rubber, natural rubber, wet urethane, dry urethane, polyether, polyester, polyvinyl chloride, polyethylene, ethylene vinyl acetate, latex, silicon, styrene isoprene styrene, styrene ethylene butylene styrene, polyvinyl alcohol, silicone agent elastomer, nitrile rubber, butyl rubber and neoprene.

The absorbing member 90 installed in the absorbing member holder 70 is fixed to the absorbing member holder 70 by the moving member 100 without any additional adhesive.

The moving member 100 is provided with a latching ring ledge 102 formed on an upper portion thereof, a coupling ring protrusion 104 is formed on an inner side wall, and a latch end ledge 106 is formed on an outer wall.

The latch ring lane 102 is latched to an upper portion of the absorbing member holder 70 to prevent the absorbing member 90 from being released. The coupling ring protrusion 104, which is formed on an inner side surface of the moving member 100, fixes the absorbing member holder 70. The latch end ledge 106 is formed on an outer side surface of the moving member 100 and is latched to the latch ledge 66 of the pump holder 60 when the moving member 100 moves up or down, so that the moving member 100 is prevented from being released.

The container cap 110 is coupled to an outside of the moving member guide 62 of the pump holder 60, so that the container cap 110 may protect the absorbing member 90 from an outside.

Hereinafter, assembling method of an airless pump container equipped with an impregnated member and an absorbing member according to an embodiment of the present invention and the state of using the same will be described as follows.

In order to assemble an airless pump container equipped with an impregnated member and an absorbing member according to the present invention, after the airless pump 50 is installed into the sealing member coupling hole 65 of the pump holder 60 while passing through the sealing member coupling hole 65 from below, the shielding member 40 is coupled to the lower portion of the airless pump 50. That is, the upper extension part 44 of the shielding member 44 is inserted into the lower extension part 64 of the pump holder 60 and at the same time, the pump coupling hole 42 of the shielding member 40 surrounds the lower end of the airless pump 50, such that an assembly of the pump holder 60, the airless pump 50 and the shielding member 40 is prepared.

Next, after the pushing plate 20 is inserted into the container main body 10, the impregnated member 30 impregnated with the gel-state contents is installed in the container main body 10. Then, the assembly of the pump holder 60, the airless pump 50 and the shielding member 40 is fitted into the inner upper end of the container main body 10. That is, the lower extension part 64 of the pump holder 60 is fitted into the inner upper end of the main body 10. Then, after the absorbing holder 70 receiving the discharge plate 80 and the absorbing member 90 is coupled to the upper end of the airless pump 50, the moving member 100, with which the absorbing member 90 and the absorbing member holder 70 are fitted to be fixed, is inserted into the moving member guide 62 of the pump holder 60.

The airless pump container equipped with an impregnated member and an absorbing member assembled by the method described above discharges the gel-state contented impregnated into impregnated member 30 when the airless pump 50 is pressed as shown in FIGS. 5 and 6, and at this time, the pushing plate 20 presses the impregnated member 300 while moving up by vacuum pressure. As show in FIG. 5, the gel-state contents passing through the airless pump 50 are evenly absorbed by the absorbing member 90 through the discharge holes 82 formed on the discharging plate 80. The gel-state contents absorbed into the absorbing member 90 may be directly coated on a skin by allowing the absorbing member 90 to make contact with the skin, or may be used by using a separated puff.

The airless pump container equipped with an impregnated member and an absorbing member described in this disclosure is for an illustrative purpose only, and the present invention is not limited thereto. Thus, it should be understood that numerous other modifications and embodiments can be devised by those skilled in the art within the spirit and scope of the present invention and they will fall within the scope of the present invention.

DESCRIPTION OF REFERENCE NUMERALS

10: Container main body
12: Air hole
20: Pushing plate
30: Impregnated member
40: Shielding member
42: Pump coupling hole
44: Upper extension part
50: Airless pump
51: Check valve
52: Housing
53: Piston road
54: Piston valve
55: Sealing member
56: Elastic member
57: Support tube
60: Pump holder
62: Moving member guide
64: Lower extension part
65: Sealing member coupling hole
66: Latch ledge
70: Absorbing member holder
77: Extension part
80: Discharge plate
82: Discharge hole
90: Absorbing member
100: Moving member
102: Latch ring ledge
104: Coupling protrusion
106: Latch end ledge
110: Container cap

The invention claimed is:

1. An airless pump container equipped with an impregnated member and an absorbing member, the airless pump container comprising:

a container main body (10) inside of which an accommodating space is formed;

a pushing plate (20) formed on an inner lower end of the container main body (10);

the impregnated member (30) installed in the container main body (10);

a shielding member (40) placed on a top end of the impregnated member (30);

a pump holder (60) coupled to an upper portion of the shielding member (40);

an airless pump (50) installed in the shielding member (40) and the pump holder (60);

an absorbing member holder (70) coupled to an upper end of the airless pump (50);

the absorbing member (90) installed in the absorbing member holder (70); and a moving member (100) for fixing the absorbing member (90) and guiding a vertical movement of the absorbing member (90), wherein the shielding member (40) is provided with a pump coupling hole (42) which is formed on a central portion of the shielding member (40) and an upper extension part (44) which is formed along an outer periphery of the shielding member (40) and coupled to the pump holder (60).

2. The airless pump container of claim 1, wherein the pump holder (60) is coupled to a container cap (110) for protecting the absorbing member (90) from an outside while being covered by the container cap (110).

3. The airless pump container of claim 1, wherein the absorbing member holder (70) is provided at a lower portion thereof with an extension part (77) coupled to the airless pump (50).

4. The airless pump container of claim 1, wherein the impregnated member (30) includes at least one of butadiene rubber, styrene butadiene rubber, natural rubber, wet urethane, dry urethane, polyether, polyester, polyvinyl chloride, polyethylene, ethylene vinyl acetate, latex, silicon, styrene isoprene styrene, styrene ethylene butylene styrene, polyvinyl alcohol, silicone agent elastomer, nitrile rubber, butyl rubber and neoprene.

5. An airless pump container equipped with an impregnated member and an absorbing member, the airless pump container comprising:

an airless pump (50) installed in a shielding member coupling hole (65) of a pump holder (60) by allowing the airless pump (50) to upwardly pass through an upper portion of the pump holder (60), an assembly having a pump holder (60), the airless pump (50) and a shielding member (40), wherein the shielding member (40) is coupled to a lower portion of the airless pump (50), a pushing plate (20) disposed inside of a container main body (10), and a moving member (100) fitted to the pump holder (60), wherein an absorbing member (90) and an absorbing member holder (70) are disposed between the moving member (100) and the pump holder (60) and the absorbing member (90) and the absorbing member holder (70) are held in place by fitting the moving member (100) and the pump holder (60) together, wherein the assembly of the pump holder (60), the airless pump (50) and the shielding member (40) is inserted into an inside of an upper end of the container main body (10) after an impregnated member (30) impregnated with content in a gel-state is installed in the container main body (10), wherein the absorbing member holder (70) receives the absorbing member (90) and the absorbing member holder (70) is attached to an upper end of the airless pump (50), and wherein the shielding member (40) is provided with a pump coupling hole (42) which is formed on a central portion of the shielding member (40) and an upper extension part (44) which is formed along an outer periphery of the shielding member (40) and coupled to the pump holder (60).

6. The airless pump container of claim 5, wherein the pump holder (60) is coupled to a container cap (110) for protecting the absorbing member (90) from an outside while being covered by the container cap (110).

7. The airless pump container of claim 5, wherein the absorbing member holder (70) is provided at a lower portion thereof with an extension part (77) coupled to the airless pump (50).

8. The airless pump container of claim 5, wherein the impregnated member (30) includes at least one of butadiene rubber, styrene butadiene rubber, natural rubber, wet urethane, dry urethane, polyether, polyester, polyvinyl chloride, polyethylene, ethylene vinyl acetate, latex, silicon, styrene isoprene styrene, styrene ethylene butylene styrene, polyvinyl alcohol, silicone agent elastomer, nitrile rubber, butyl rubber and neoprene.

9. An airless pump container equipped with an impregnated member and an absorbing member, the airless pump container comprising:

an airless pump (50) installed in a shielding member coupling hole (65) of a pump holder (60) by allowing the airless pump (50) to upwardly pass through an upper portion of the pump holder (60), an assembly having a pump holder (60), the airless pump (50) and a shielding member (40), wherein the shielding member (40) is coupled to a lower portion of the airless pump (50), a pushing plate (20) disposed inside of a container main body (10), and a moving member (100) fitted to the pump holder (60), wherein an absorbing member (90) and an absorbing member holder (70) are disposed between the moving member (100) and the pump holder (60) and the absorbing member (90) and the absorbing member holder (70) are held in place by fitting the moving member (100) and the pump holder (60) together, wherein the assembly of the pump holder (60), the airless pump (50) and the shielding member (40) is inserted into an inside of an upper end of the container main body (10) after an impregnated member (30) impregnated with content in a gel-state is installed in the container main body (10), wherein the absorbing member holder (70) receives the absorbing member (90) and the absorbing member holder (70) is attached to an upper end of the airless pump (50), wherein the pump holder (60) includes a moving member guide (62) for guiding a vertical movement of the moving member (100) and a lower extension part (64) coupled to the upper extension part (44) of the shielding member (40).

10. An airless pump container equipped with an impregnated member and an absorbing member, the airless pump container comprising:

an airless pump (50) installed in a shielding member coupling hole (65) of a pump holder (60) by allowing the airless pump (50) to upwardly pass through an upper portion of the pump holder (60), an assembly having a pump holder (60), the airless pump (50) and a shielding member (40), wherein the shielding member (40) is coupled to a lower portion of the airless pump (50), a pushing plate (20) disposed inside of a container main body (10), and a moving member (100) fitted to the pump holder (60), wherein an absorbing member (90) and an absorbing member holder (70) are disposed between the moving member (100) and the pump holder (60) and the absorbing member (90) and the absorbing member holder (70) are held in place by fitting the moving member (100) and the pump holder (60) together, wherein the assembly of the pump holder (60), the airless pump (50) and the shielding member (40) is inserted into an inside of an upper end of the container main body (10) after an impregnated member (30) impregnated with content in a gel-state is installed in the container main body (10), wherein the absorbing member holder (70) receives the absorbing member (90) and the absorbing member holder (70) is attached to an upper end of the airless pump (50), wherein the absorbing member holder (70) is provided therein with a discharge plate (80) having a discharge hole (82) to allow the content in the gel state to be evenly absorbed into the absorbing member (90).

11. An airless pump container equipped with an impregnated member and an absorbing member, the airless pump container comprising:

an airless pump (50) installed in a shielding member coupling hole (65) of a pump holder (60) by allowing the airless pump (50) to upwardly pass through an upper portion of the pump holder (60), an assembly having a pump holder (60), the airless pump (50) and a shielding member (40), wherein the shielding member (40) is coupled to a lower portion of the airless pump (50), a pushing plate (20) disposed inside of a container main body (10), and a moving member (100) fitted to the pump holder (60), wherein an absorbing member (90) and an absorbing member holder (70) are disposed between the moving member (100) and the pump holder (60) and the absorbing member (90) and the absorbing member holder (70) are held in place by fitting the moving member (100) and the pump holder (60) together, wherein the assembly of the pump holder (60), the airless pump (50) and the shielding member (40) is inserted into an inside of an upper end of the container main body (10) after an impregnated member (30) impregnated with content in a gel-state is installed in the container main body (10), wherein the absorbing member holder (70) receives the absorbing member (90) and the absorbing member holder (70) is attached to an upper end of the airless pump (50), wherein the moving member (100) is provided with a coupling ring protrusion (104) for fixing the absorbing member holder (70) on which the absorbing member (90) is installed.

12. The airless pump container of claim 11, wherein the moving member (100) is provided at an upper portion thereof with a latching ring ledge (102) to fix the absorbing member (90).

13. An airless pump container equipped with an impregnated member and an absorbing member, the airless pump container comprising:

a container main body (10) inside of which an accommodating space is formed;

a pushing plate (20) formed on an inner lower end of the container main body (10);

the impregnated member (30) installed in the container main body (10);

a shielding member (40) placed on a top end of the impregnated member (30);

a pump holder (60) coupled to an upper portion of the shielding member (40);

an airless pump (50) installed in the shielding member (40) and the pump holder (60);

an absorbing member holder (70) coupled to an upper end of the airless pump (50);

the absorbing member (90) installed in the absorbing member holder (70); and a moving member (100) for fixing the absorbing member (90) and guiding a vertical movement of the absorbing member (90), wherein the pump holder (60) includes a moving member guide (62) for guiding a vertical movement of the moving member (100) and a lower extension part (64) coupled to the upper extension part (44) of the shielding member (40).

14. An airless pump container equipped with an impregnated member and an absorbing member, the airless pump container comprising:

a container main body (10) inside of which an accommodating space is formed;

a pushing plate (20) formed on an inner lower end of the container main body (10);

the impregnated member (30) installed in the container main body (10);

a shielding member (40) placed on a top end of the impregnated member (30);

a pump holder (60) coupled to an upper portion of the shielding member (40);

an airless pump (50) installed in the shielding member (40) and the pump holder (60);

an absorbing member holder (70) coupled to an upper end of the airless pump (50);

the absorbing member (90) installed in the absorbing member holder (70); and a moving member (100) for fixing the absorbing member (90) and guiding a vertical movement of the absorbing member (90), wherein the absorbing member holder (70) is provided therein with a discharge plate (80) having a discharge hole (82) to allow the content in the gel state to be evenly absorbed into the absorbing member (90).

15. An airless pump container equipped with an impregnated member and an absorbing member, the airless pump container comprising:

a container main body (10) inside of which an accommodating space is formed;

a pushing plate (20) formed on an inner lower end of the container main body (10);

the impregnated member (30) installed in the container main body (10);

a shielding member (40) placed on a top end of the impregnated member (30);

a pump holder (60) coupled to an upper portion of the shielding member (40);

an airless pump (50) installed in the shielding member (40) and the pump holder (60);

an absorbing member holder (70) coupled to an upper end of the airless pump (50);

the absorbing member (90) installed in the absorbing member holder (70); and a moving member (100) for fixing the absorbing member (90) and guiding a vertical movement of the absorbing member (90), wherein the moving member (100) is provided with a coupling ring protrusion (104) for fixing the absorbing member holder (70) on which the absorbing member (90) is installed.

16. The airless pump container of claim 15, wherein the moving member (100) is provided at an upper portion thereof with a latching ring ledge (102) to fix the absorbing member (90).

* * * * *